US008377523B2

(12) United States Patent
Wu

(10) Patent No.: US 8,377,523 B2
(45) Date of Patent: Feb. 19, 2013

(54) INTERMEDIATE TRANSFER MEMBERS

(76) Inventor: Jin Wu, Webster, NY (US)

( * ) Notice: Subject to any disclaimer, the term of this patent is extended or adjusted under 35 U.S.C. 154(b) by 905 days.

(21) Appl. No.: 12/493,535

(22) Filed: Jun. 29, 2009

(65) Prior Publication Data

US 2010/0330305 A1 Dec. 30, 2010

(51) Int. Cl.
*B41M 5/40* (2006.01)

(52) U.S. Cl. ..... 428/32.69; 428/32.72; 428/32.81; 428/32.86; 428/412; 428/413; 428/423.1; 428/447; 428/473.5; 428/474.4; 428/480

(58) Field of Classification Search ..... 428/32.69, 428/32.72, 32.81, 32.86, 412, 413, 423.1, 428/447, 473.5, 474.4, 480
See application file for complete search history.

(56) References Cited

U.S. PATENT DOCUMENTS

| | | | | |
|---|---|---|---|---|
| 5,487,707 | A | 1/1996 | Sharf et al. | |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 2005/0196202 | A1 | 9/2005 | Suzuki et al. | |
| 2006/0118540 | A1 * | 6/2006 | Beach et al. | 219/216 |
| 2008/0014528 | A1 * | 1/2008 | Bailey et al. | 430/200 |
| 2008/0035265 | A1 * | 2/2008 | Zaretsky et al. | 156/73.1 |

FOREIGN PATENT DOCUMENTS

| | | |
|---|---|---|
| JP | A-2004-170831 | 6/2004 |
| JP | A-2006-348094 | 12/2006 |
| JP | A-2007-121619 | 5/2007 |

OTHER PUBLICATIONS

May 4, 2011 European Search Report issued in BP 10 16 7188.
Jin Wu, U.S. Appl. No. 12/413,645 entitled Layered Intermediate Transfer Members, filed Mar. 30, 2009.
Jin Wu, U.S. Appl. No. 12/413,633 entitled Fluorinated Sulfonic Acid Polymer Grafted Polyaniline Containing Intermediate Transfer Members, filed Mar. 30, 2009.
Jin Wu, U.S. Appl. No. 12/413,638 entitled Perfluoropolyether Polymer Grafted Polyaniline Containing Intermediate Transfer Members, filed Mar. 30, 2009.
Jin Wu, U.S. Appl. No. 12/413,642 entitled Fluorotelomer Grafted Polyaniline Containing Intermediate Transfer Members, filed Mar. 30, 2009.
Jin Wu, U.S. Appl. No. 12/413,651 entitled Polyimide Polysiloxane Intermediate Transfer Members, filed Mar. 30, 2009.
Jin Wu, U.S. Appl. No. 12/413,832 entitled Polyaniline Dialkylsulfate Complexes Containing Intermediate Transfer Members, filed Mar. 30, 2009.
Jin Wu, U.S. Appl. No. 12/200,074 entitled Hydrophobic Carbon Black Intermediate Transfer Components, filed Aug. 28, 2008.
Jin Wu, U.S. Appl. No. 12/200,111 entitled Hydrophobic Polyetherimide/Polysiloxane Copolymer Intermediate Transfer Components, filed Aug. 28, 2008.
Jin Wu, U.S. Appl. No. 12/129,995 on Polyimide Intermediate Transfer Components, filed May 30, 2008.

* cited by examiner

*Primary Examiner* — Betelhem Shewareged
(74) *Attorney, Agent, or Firm* — Eugene O. Palazzo

(57) ABSTRACT

An intermediate transfer media, such as a belt, that includes a first supporting substrate, such as a polyimide substrate layer, and a second layer of a silicone containing polyamideimide layer. Also, the intermediate transfer media can include a silicone containing polyamideimide single layer.

34 Claims, No Drawings

INTERMEDIATE TRANSFER MEMBERS

CROSS REFERENCE TO RELATED APPLICATIONS

Copending U.S. application Ser. No. 12/413,645, filed Mar. 30, 2009, the disclosure of which is totally incorporated herein by reference, illustrates an intermediate transfer member comprised of a polyimide substrate, and thereover a polyetherimide/polysiloxane.

Copending U.S. application Ser. No. 12/413,633, filed Mar. 30, 2009, entitled Fluorinated Sulfonic Acid Polymer Grafted Polyaniline Containing Intermediate Transfer Members, the disclosure of which is totally incorporated herein by reference, illustrates an intermediate transfer member comprised of a substrate, and in contact therewith a polyaniline having grafted thereto a fluorinated sulfonic acid polymer.

Copending U.S. application Ser. No. 12/413,638, filed Mar. 30, 2009, entitled Perfluoropolyether Polymer Grafted Polyaniline Containing Intermediate Transfer Members, the disclosure of which is totally incorporated herein by reference, illustrates an intermediate transfer member comprised of a substrate and in contact with the substrate a polyaniline grafted perfluoropolyether phosphoric acid polymer.

Copending U.S. application Ser. No. 12/413,642, filed Mar. 30, 2009, entitled Fluorotelomer Grafted Polyaniline Containing Intermediate Transfer Members, the disclosure of which is totally incorporated herein by reference, illustrates an intermediate transfer member comprised of a substrate, and a layer comprised of polyaniline having grafted thereto a fluorotelomer.

Copending U.S. application Ser. No. 12/413,651, filed Mar. 30, 2009, entitled Polyimide Polysiloxane Intermediate Transfer Members, the disclosure of which is totally incorporated herein by reference, illustrates an intermediate transfer member comprised of at least one of a polyimide/polyetherimide/polysiloxane, and a polyimide polysiloxane.

Copending U.S. application Ser. No. 12/413,832, filed Mar. 30, 2009, entitled Polyaniline Dialkylsulfate Complexes Containing Intermediate Transfer Members, the disclosure of which is totally incorporated herein by reference, illustrates an intermediate transfer member comprised of a polyaniline dialkylsulfate complex.

Illustrated in U.S. application Ser. No. 12/200,074, entitled Hydrophobic Carbon Black Intermediate Transfer Components, filed Aug. 28, 2008, the disclosure of which is totally incorporated herein by reference, is an intermediate transfer member comprised of a substrate comprising a carbon black surface treated with a poly(fluoroalkyl acrylate).

Illustrated in U.S. application Ser. No. 12/200,111, entitled Hydrophobic Polyetherimide/Polysiloxane Copolymer Intermediate Transfer Components, filed Aug. 28, 2008, is an intermediate transfer member comprised of a substrate comprising a polyetherimide polysiloxane copolymer.

Illustrated in U.S. application Ser. No. 12/129,995, filed May 30, 2008, the disclosure of which is totally incorporated herein by reference, entitled Polyimide Intermediate Transfer Components, the disclosure of which is totally incorporated herein by reference, is an intermediate transfer belt comprised of a substrate comprising a polyimide and a conductive component wherein the polyimide is cured at a temperature of for example, from about 175° C. to about 290° C. over a period of time of from about 10 to about 120 minutes.

BACKGROUND

Disclosed are intermediate transfer members, and more specifically, intermediate transfer members useful in transferring a developed image in an electrostatographic, for example xerographic, including digital, image on image, and the like, machines or apparatuses and printers. In embodiments, there are selected intermediate transfer members comprised of a first polyimide layer and a second silicone modified polyamideimide surface layer, and wherein each layer optionally further includes a conductive component, or alternatively wherein the intermediate transfer member is comprised of a silicone modified polyamideimide surface layer, optionally further including a conductive component.

A number of advantages are associated with the intermediate transfer members of the present disclosure in embodiments thereof, such as excellent mechanical characteristics, robustness, consistent, and excellent surface resistivities, excellent image transfer (toner transfer and cleaning) primarily in view of the use of a lower surface tension silicone modified polyamideimide surface layer, as compared to a conventional polyimide base layer; acceptable adhesion properties, when there is included in the plural layered intermediate transfer member an adhesive layer; excellent maintained conductivity or resistivity for extended time periods; dimensional stability; ITB humidity insensitivity for extended time periods; excellent dispersability in a polymeric solution; low and acceptable surface friction characteristics; and minimum or substantially no peeling or separation of the layers.

In aspects thereof, the present disclosure relates to a multi layer intermediate transfer member, such as a belt (ITB) comprised of a silicone modified polyamideimide surface layer or comprised of a silicone modified polyamideimide surface layer and polyimide base layer, and where each layer further includes a conductive component, and for the plural layered member an optional adhesive layer situated between the two layers, and which layered member can be prepared by known solution casting methods and known extrusion molded processes with the optional adhesive layer can be generated, and applied by known spray coating and flow coating processes.

Furthermore, disclosed herein is a hydrophobic intermediate transfer member having a surface resistivity of from about $10^8$ to about $10^{13}$ ohm/sq, or from about $10^9$ to about $10^{12}$ ohm/sq, and a bulk resistivity of from about $10^8$ to about $10^{13}$ ohm cm, or from about $10^9$ to about $10^{12}$ ohm cm. In addition, primarily because of the ITB water repelling properties determined, for example, by accelerated aging experiments at 80° F./80 percent humidity, for four weeks, the surface resistivity of the disclosed hydrophobic ITB member is expected to remain unchanged, while that of a similar comparative ITB member, which is free of the silicone modified polyamideimide, varies.

In a typical electrostatographic reproducing apparatus, such as a xerographic copiers, printers, multifunctional machines, a light image of an original to be copied is recorded in the form of an electrostatic latent image upon a photosensitive member or a photoconductor, and the latent image is subsequently rendered visible by the application of electroscopic thermoplastic resin particles and colorant. Generally, the electrostatic latent image is developed by contacting it with a developer mixture comprised of a dry developer mixture, which usually comprises carrier granules having toner particles adhering triboelectrically thereto, or a liquid developer material, which may include a liquid carrier having toner particles dispersed therein. The developer material is advanced into contact with the electrostatic latent image, and the toner particles are deposited thereon in image configuration. Subsequently, the developed image is transferred to a copy sheet. It is advantageous to transfer the developed image to a coated intermediate transfer web, belt or component, and subsequently, transfer with a high transfer efficiency the developed image from the intermediate transfer member to a permanent substrate. The toner image is subsequently usually fixed or fused upon a support, which may be the photosensitive member itself, or other support sheet such as plain paper.

In electrostatographic printing machines, wherein the toner image is electrostatically transferred by a potential difference between the imaging member or photoconductor and the intermediate transfer member, the transfer of the toner particles to the intermediate transfer member, and the retention thereof should be substantially complete so that the image ultimately transferred to the image receiving substrate will have a high resolution. Substantially about 100 percent toner transfer occurs when most or all of the toner particles comprising the image are transferred, and little residual toner remains on the surface from which the image was transferred.

Intermediate transfer members possess a number of advantages, such as enabling high throughput at modest process speeds; improving registration of the final color toner image in color systems using synchronous development of one or more component colors, and using one or more transfer stations; and increasing the number of substrates that can be selected. However, a disadvantage of using an intermediate transfer member is that a plurality of transfer operations is usually needed allowing for the possibility of charge exchange occurring between toner particles and the transfer member, which ultimately can lead to less than complete toner transfer, resulting in low resolution images on the image receiving substrate, and image deterioration. When the image is in color, the image can additionally suffer from color shifting and color deterioration.

Attempts at controlling the resistivity of intermediate transfer members by, for example, adding conductive fillers, such as ionic additives and/or carbon black to the outer layer, are disclosed in U.S. Pat. No. 6,397,034 which describes the use of fluorinated carbon filler in a polyimide intermediate transfer member layer. However, there can be problems associated with the use of such fillers in that undissolved particles frequently bloom or migrate to the surface of the fluorinated polymer and cause imperfections to the polymer, thereby causing nonuniform resistivity, which in turn causes poor antistatic properties and poor mechanical strength characteristics. Also, ionic additives on the ITB surface may interfere with toner release. Furthermore, bubbles may appear in the polymer, some of which can only be seen with the aid of a microscope, and others of which are large enough to be observed with the naked eye resulting in poor or nonuniform electrical properties, and poor mechanical properties.

In addition, the ionic additives themselves are sensitive to changes in temperature, humidity, and operating time. These sensitivities often limit the resistivity range. For example, the resistivity usually decreases by up to two orders of magnitude or more as the humidity increases from about 20 percent to 80 percent relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude, and eventually the ion filled polymer member will be unusable.

Therefore, it is desired to provide an intermediate transfer member with a number of the advantages illustrated herein, such as excellent mechanical, and humidity insensitivity characteristics, permitting high copy quality where developed images with minimal resolution issues can be obtained. It is also desired to provide a weldable intermediate transfer belt that may not, but could, have puzzle cut seams, and instead has a weldable seam, thereby providing a belt that can be manufactured without labor intensive steps, such as manually piecing together the puzzle cut seam with fingers, and without the lengthy high temperature and high humidity conditioning steps.

REFERENCES

Illustrated in U.S. Pat. No. 7,031,647 is an imageable seamed belt containing a lignin sulfonic acid doped polyaniline.

Illustrated in U.S. Pat. No. 7,139,519 is an intermediate transfer belt, comprising a belt substrate comprising primarily at least one polyimide polymer; and a welded seam.

Illustrated in U.S. Pat. No. 7,130,569 is a weldable intermediate transfer belt comprising a substrate comprising a homogeneous composition comprising a polyaniline in an amount of, for example, from about 2 to about 25 percent by weight of total solids, and a thermoplastic polyimide present in an amount of from about 75 to about 98 percent by weight of total solids, wherein the polyaniline has a particle size of, for example, from about 0.5 to about 5 microns.

Puzzle cut seam members are disclosed in U.S. Pat. Nos. 5,487,707; 6,318,223, and 6,440,515.

Illustrated in U.S. Pat. No. 6,602,156 is a polyaniline filled polyimide puzzle cut seamed belt, however, the manufacture of a puzzle cut seamed belt is labor intensive and costly, and the puzzle cut seam, in embodiments, is sometimes weak. The manufacturing process for a puzzle cut seamed belt usually involves a lengthy in time high temperature and high humidity conditioning step. For the conditioning step, each individual belt is rough cut, rolled up, and placed in a conditioning chamber that is environmentally controlled at about 45° C. and about 85 percent relative humidity, for approximately 20 hours. To prevent or minimize condensation and watermarks, the puzzle cut seamed transfer belt resulting is permitted to remain in the conditioning chamber for a suitable period of time, such as 3 hours. The conditioning of the transfer belt renders it difficult to automate the manufacturing thereof, and the absence of such conditioning may adversely impact the belts electrical properties, which in turn results in poor image quality.

SUMMARY

In embodiments, there is disclosed an intermediate transfer member comprised of a silicone containing polyamideimide; an intermediate transfer member comprised of a silicone containing polyamideimide as represented by

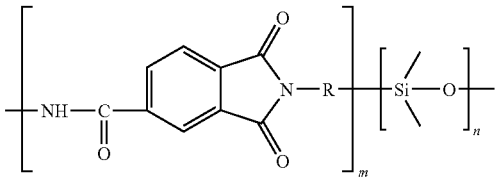

wherein R is alkyl, aryl, or mixtures of alkyl and aryl, and m and n represent the weight percent of each segment; an intermediate transfer member comprised of a polyimide supporting substrate layer, and thereover a silicone containing polyamideimide layer as represented by

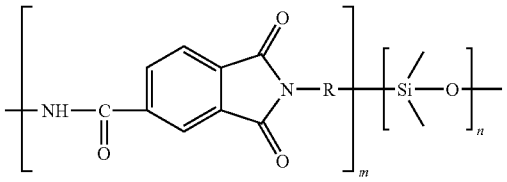

wherein R is alkyl, aryl, or mixtures thereof, and m and n represent the number of segments, and more specifically, where m and n represent the weight percent of each segment; an intermediate transfer member comprised of a silicone containing polyamideimide layer or a silicone containing polyamideimide surface layer and polyimide supporting substrate; a transfer media comprised of a polyimide first supporting substrate layer and thereover a second layer comprised of a silicone containing polyamideimide, an adhesive layer situated between the first layer and the second layer, and wherein at least one of the first layer and the second layer further contain a known conductive component like carbon black, a polyaniline, and the like; an intermediate transfer belt comprised of a polyimide substrate layer, and thereover a layer comprised of a silicone containing polyamideimide, and wherein at least one of the substrate layer and the silicone containing polyamideimide layer includes a conductive component, and wherein the silicone containing polyamideimide is represented by

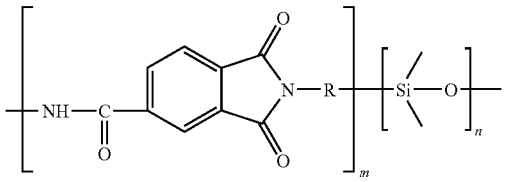

wherein R is at least one of alkyl and aryl, and m and n represent the weight percent of repeating segments or groups, and more specifically, where m is, for example, from about 60 to about 99 weight percent, from about 70 to about 95 weight percent, or from about 80 to about 90 weight percent, and other suitable percentages, and n is, for example, from about 1 to about 40, or from 10 to about 20 weight percent, and wherein the total of the components in the silicone containing polyamideimide is about 100 percent; wherein the weight average molecular weight of the silicone containing polyamideimide is from about 5,000 to about 150,000, or from about 10,000 to about 50,000; wherein the substrate, when present, is of a thickness of from about 10 to about 150 microns, and the silicone containing polyamideimide in the form of a layer is of a thickness of from about 1 to about 150 microns, wherein the weight percent of the silicone is from about 1 to about 40, or from about 10 to about 30, and wherein the total of the components in the silicone containing polyamideimide layer is about 100 percent; an intermediate transfer member, such as an intermediate belt, comprised of a major amount of a silicone containing polyamideimide substrate; an intermediate transfer member comprising, for example, a polyimide supporting substrate, and thereover a layer comprised of a silicone containing polyamideimide that further includes a conductive component like carbon black; a silicone containing polyamideimide intermediate layer where the polyamideimide (PAI) can be synthesized by at least the following two methods (1) isocyanate method which involves the reaction between isocyanate and trimellitic anhydride; or (2) acid chloride method where there is reacted a diamine and trimellitic anhydride chloride. A third reactant can also be selected, such as an amine terminated polydimethylsiloxane (silicone), resulting in the formation of the silicone containing polyamideimide. The silicone containing polyamideimides selected for the intermediate transfer members of the present disclosure are available from, for example, Toyobo Company of Japan, and more specifically, where a silicone containing polyamideimide is commercially available from Toyobo Company as VYLOMAX® HR-14ET (25 weight percent solution in ethanol/toluene=50/50, $T_g$=250° C., and $M_w$=10,000).

Specific examples of the silicone containing polyamideimides that may be selected for the intermediate transfer member, inclusive of an intermediate transfer belt, include a number of known polymers such as

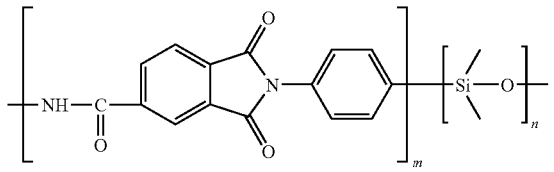

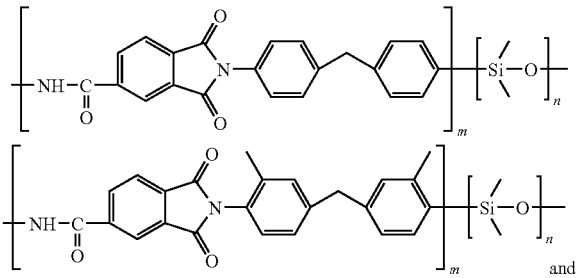

and

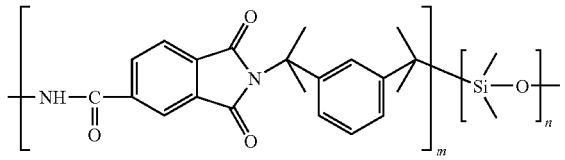

wherein m and n represent the weight percent of repeating segments or groups, and more specifically, where m is from about 60 to about 99 weight percent, from about 70 to about 95 weight percent, or from about 80 to about 90 weight percent, and other suitable percentages, and n is, for example, as illustrated herein, and wherein the total of the components in the silicone containing polyamideimide is about 100 percent.

In embodiments, the glass transition temperature of the silicone containing polyamideimide is from about 225° C. to about 350° C., from about 250° C. to about 300° C., and from about 250° C. to about 270° C., and more specifically, about 250° C.

Examples of thermosetting polyimides that can be incorporated into the intermediate transfer member (ITM) include known low temperature and rapidly cured polyimide polymers, such as VTEC™ PI 1388, 080-051, 851, 302, 203, 201, and PETI-5, all available from Richard Blaine International, Incorporated, Reading, Pa. These thermosetting polyimides can be cured at temperatures of from about 180° C. to about 260° C. over a short period of time, such as from about 10 to about 120 minutes, or from about 20 to about 60 minutes; possess a number average molecular weight of from about 5,000 to about 500,000, or from about 10,000 to about 100,000, and a weight average molecular weight of from about 50,000 to about 5,000,000, or from about 100,000 to about 1,000,000. Other thermosetting polyimides that can be selected for the ITM or ITB, and cured at temperatures of above 300° C. include PYRE M.L® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100 commercially available from FUJIFILM Electronic Materials U.S.A., Inc., North Kingstown, R.I.; and KAPTON® HN, VN and FN, all commercially available from E.I. DuPont, Wilmington, Del.

Suitable supporting substrate polyimides include those formed from various diamines and dianhydrides, such as polyimide, polyamideimide, polyetherimide, and the like. More specifically, polyimides include aromatic polyimides such as those formed by reacting pyromellitic acid and diaminodiphenylether, or by imidization of copolymeric acids, such as biphenyltetracarboxylic acid and pyromellitic acid with two aromatic diamines, such as p-phenylenediamine and diaminodiphenylether. Another suitable polyimide includes pyromellitic dianhydride and benzophenone tetracarboxylic dianhydride copolymeric acids reacted with 2,2-bis[4-(8-aminophenoxy)phenoxy]-hexafluoropropane. Aromatic polyimides include those containing 1,2,1',2'-biphenyltetracarboximide and para-phenylene groups, and those having biphenyltetracarboximide functionality with diphenylether end spacer characterizations. Mixtures of polyimides can also be used.

In embodiments, the polyamideimides can be synthesized by at least the following two methods (1) isocyanate method which involves the reaction between isocyanate and trimellitic anhydride; or (2) acid chloride method where there is reacted a diamine and trimellitic anhydride chloride. Examples of these polyamideimides include VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

The conductive material, such as a carbon black, a metal oxide or a polyaniline, is present in at least one layer of the intermediate transfer member in, for example, an amount of from about 1 to about 30 weight percent, from about 3 to about 20 weight percent, or specifically from about 5 to about 15 weight percent.

Carbon black surface groups can be formed by oxidation with an acid or with ozone, and where there is absorbed or chemisorbed oxygen groups from, for example, carboxylates, phenols, and the like. The carbon surface is essentially inert to most organic reaction chemistry except primarily for oxidative processes and free radical reactions.

The conductivity of carbon black is dependent on surface area and its structure primarily. Generally, the higher the surface area and the higher the structure, the more conductive is the carbon black. Surface area is measured by the B.E.T. nitrogen surface area per unit weight of carbon black, and is the measurement of the primary particle size. Structure is a complex property that refers to the morphology of the primary aggregates of carbon black. It is a measure of both the number of primary particles comprising primary aggregates, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks selected as the conductive component for the ITM include VULCAN® carbon blacks, REGAL® carbon blacks, MONARCH® carbon blacks and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), VULCAN®XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); Channel carbon blacks available from Evonik-Degussa; Special Black 4 (B.E.T. surface area=180 $m^2/g$, DBP absorption=1.8 ml/g, primary particle diameter=25 nanometers), Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), and Color Black FW200 (B.E.T. surface area=460 $m^2/g$, DBP absorption=4.6 ml/g, primary particle diameter=13 nanometers).

The carbon black is usually formed into a dispersion, such as a carbon black blend of the silicone containing polyamideimide or a carbon black blend of silicone containing polyamideimide and the polyimide. With proper milling processes, uniform dispersions can be obtained, and then coated on glass plates using a draw bar coating method. The resulting individual films can be dried at high temperatures, such as from about 100° C. to about 400° C., for a suitable period of time, such as from about 20 to about 180 minutes, while remaining on the separate glass plates. After drying and cooling to room temperature, about 23° C. to about 25° C., the films on the glass plates can be immersed into water overnight, about 18 to 23 hours, and subsequently, the 50 to 150 micron thick films can be released from the glass to form a functional intermediate transfer member.

In embodiments, the polyaniline component has a relatively small particle size of from about 0.5 to about 5 microns, from about 1.1 to about 2.3 microns, from about 1.2 to about 2 microns, from about 1.5 to about 1.9 microns, or about 1.7 microns. Specific examples of polyanilines selected for the transfer member, such as an ITB, are PANIPOL™ F, commercially available from Panipol Oy, Finland.

The silicone containing polyamideimide layer can further include a number of known polymers, such as a polyimide, a polyamideimide, a polyetherimide, a polycarbonate, a polyester, a polyvinylidene fluoride, a polysulfone, a polyamide, a polyethylene-co-polytetrafluoroethylene and the like, present in an amount of from about 1 to about 90 weight percent, or from about 30 to about 70 weight percent of the total intermediate transfer member.

Adhesive layer components for the plural layered members, and which adhesive layer is usually situated between the supporting substrate, and the top silicone containing polyamideimide thereover are, for example, a number of resins or polymers of epoxy, urethane, silicone, polyester, and the like. Generally, the adhesive layer is a solventless layer that is materials that are liquid at room temperature (about 25° C.), and are able to crosslink to an elastic or rigid film to adhere at least two materials together. Specific adhesive layer components include 100 percent solids adhesives including polyurethane adhesives obtained from Lord Corporation, Erie, Pa., such as TYCEL® 7924 (viscosity from about 1,400 to about 2,000 cps), TYCEL® 7975 (viscosity from about 1,200 to about 1,600 cps) and TYCEL® 7276. The viscosity range of the adhesives is, for example, from about 1,200 to about 2,000 cps. The solventless adhesives can be activated with either heat, room temperature curing, moisture curing, ultraviolet radiation, infrared radiation, electron beam curing, or any other known technique. The thickness of the adhesive layer is usually less than about 100 nanometers, and more specifically, as illustrated hereinafter.

The thickness of each layer of the intermediate transfer member can vary, and is usually not limited to any specific value. In specific embodiments, the substrate layer or first layer thickness is, for example, from about 20 to about 300 microns, from about 30 to about 200 microns, from about 75 to about 150 microns, and from about 50 to about 100 microns, while the thickness of the top silicone containing polyamideimide, when present, is, for example, from about 1 to about 150 microns, from about 10 to about 100 microns, from about 20 to about 70 microns, and from about 30 to about 50 microns. The adhesive layer thickness is, for example, from about 1 to about 100 nanometers, from about 5 to about 75 nanometers, or from about 50 to about 100 nanometers.

The disclosed intermediate transfer members are, in embodiments, weldable, that is the seam of the member like a belt is weldable, and more specifically, may be ultrasonically welded to produce a seam. The surface resistivity of the disclosed intermediate transfer member is, for example, from about $10^9$ to about $10^{13}$ ohm/sq, or from about $10^{10}$ to about $10^{12}$ ohm/sq. The sheet resistivity of the intermediate transfer weldable member is, for example, from about $10^9$ to about $10^{13}$ ohm/sq, or from about $10^{10}$ to about $10^{12}$ ohm/sq.

The intermediate transfer members illustrated herein like intermediate transfer belts can be selected for a number of printing, and copying systems, inclusive of xerographic printing. For example, the disclosed intermediate transfer members can be incorporated into a multi-imaging system where each image being transferred is formed on the imaging or photoconductive drum at an image forming station, wherein each of these images is then developed at a developing station, and transferred to the intermediate transfer member. The images may be formed on the photoconductor and developed sequentially, and then transferred to the intermediate transfer member. In an alternative method, each image may be formed on the photoconductor or photoreceptor drum, developed, and transferred in registration to the intermediate transfer member. In an embodiment, the multi-image system is a color copying system, wherein each color of an image being copied is formed on the photoreceptor drum, developed, and transferred to the intermediate transfer member.

Subsequent to the toner latent image being transferred from the photoreceptor drum to the intermediate transfer member, the intermediate transfer member may be contacted under heat and pressure with an image receiving substrate such as paper. The toner image on the intermediate transfer member is then transferred and fixed, in image configuration, to the substrate such as paper.

The intermediate transfer member present in the imaging systems illustrated herein, and other known imaging and printing systems, may be in the configuration of a sheet, a web, a belt, including an endless belt, an endless seamed flexible belt, and an endless seamed flexible belt; a roller, a film, a foil, a strip, a coil, a cylinder, a drum, an endless strip, and a circular disc. The intermediate transfer member can be comprised of a single layer, or it can be comprised of several layers, such as from about 2 to about 5 layers. In embodiments, the intermediate transfer member further includes an outer release layer.

Release layer examples situated on and in contact with the silicone containing polyamideimide member include low surface energy materials, such as TEFLON®-like materials including fluorinated ethylene propylene copolymer (FEP), polytetrafluoroethylene (PTFE), polyfluoroalkoxy polytetrafluoroethylene (PFA TEFLON®) and other TEFLON®-like materials; silicone materials such as fluorosilicones and silicone rubbers such as Silicone Rubber 552, available from Sampson Coatings, Richmond, Va., (polydimethyl siloxane/dibutyl tin diacetate, 0.45 gram DBTDA per 100 grams polydimethyl siloxane rubber mixture, with, for example, a molecular weight $M_w$ of approximately 3,500); and fluoroelastomers such as those available as VITON® such as copolymers and terpolymers of vinylidenefluoride, hexafluoropropylene, and tetrafluoroethylene, which are known commercially under various designations as VITON A®, VITON E®, VITON E60C®, VITON E45®, VITON E430®, VITON B910®, VITON GH®, VITON B50®, VITON E45®, and VITON GF®. The VITON® designation is a Trademark of E.I. DuPont de Nemours, Inc. Two known fluoroelastomers are comprised of (1) a class of copolymers of vinylidenefluoride, hexafluoropropylene, and tetrafluoroethylene, known commercially as VITON A®, (2) a class of terpolymers of vinylidenefluoride, hexafluoropropylene and tetrafluoroethylene known commercially as VITON B®, and (3) a class of tetrapolymers of vinylidenefluoride, hexafluoropropylene, tetrafluoroethylene, and a cure site monomer, such as VITON GF®, having 35 mole percent of vinylidenefluoride, 34 mole percent of hexafluoropropylene, and 29 mole percent of tetrafluoroethylene with 2 percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoperfluoropropene-1, or any other suitable known commercially available cure site monomer.

The layer or layers may be deposited on the substrate by known coating processes. Known methods for forming the outer layer(s) on the substrate film, such as dipping, spraying, such as by multiple spray applications of very thin films, casting, flow coating, web coating, roll coating, extrusion, molding, or the like, can be used. In embodiments, the layer or layers can be deposited or generated by spraying such as by multiple spray applications of thin films, casting, by web coating, by flow coating, and most preferably, by laminating.

The circumference of the intermediate transfer member, especially as it is applicable to a film or a belt configuration, is, for example, from about 250 to about 2,500 millimeters, from about 1,500 to about 3,000 millimeters, or from about 2,000 to about 2,200 millimeters with a corresponding width of, for example, from about 100 to about 1,000 millimeters, from about 200 to about 500 millimeters, or from about 300 to about 400 millimeters.

Specific embodiments will now be described in detail. These examples are intended to be illustrative, and are not limited to the materials, conditions, or process parameters set forth in these embodiments. All parts are percentages by weight of total solids unless otherwise indicated.

COMPARATIVE EXAMPLE 1

Preparation of a Polyamideimide Containing Intermediate Transfer Member

One gram of Color Black FW1 (B.E.T. surface area=320 $m^2/g$, DBP absorption=2.89 ml/g, primary particle diameter=13 nanometers) as obtained from Evonik-Degussa, was mixed with 37.5 grams of the polyamideimide, VYLOMAX® HR-16NN (14 weight percent solution in N-methylpyrrolidone, $T_g$=320° C., and $M_w$=100,000) as obtained from Toyobo Company, and 39.6 grams of N-methylpyrrolidone. By ball milling this mixture with 2 millimeter stainless shot with an Attritor for 1 hour, a uniform dispersion was obtained. The resulting dispersion was then coated on a glass plate using a draw bar coating method. Subsequently, the film obtained was dried at 100° C. for 20 minutes, and then 200° C. for an additional 120 minutes while remaining on the glass plate.

The film on the glass was then immersed into water overnight, about 23 hours, and the freestanding film was released from the glass automatically resulting in an intermediate transfer member with a 50 micron thick carbon black/polyamideimide layer with a ratio by weight percent of 16 carbon black and 84 polyamideimide.

EXAMPLE I

Preparation of a Single Layer Silicone Containing Polyamideimide Intermediate Transfer Member One gram of Color Black FW1 (B.E.T. surface area=320 $m^2/g$, DBP absorption=2.89 ml/g, primary particle diameter=13 nanometers) as obtained from Evonik-Degussa, was mixed with 21 grams of a silicone containing polyamideimide, VYLOMAX® HR-14ET (25 weight percent solution in ethanol/toluene=50/50, $T_g$=250° C., and $M_w$=10,000) as obtained from Toyobo Company. By ball milling this mixture with 2 millimeter stainless shot with an Attritor for 1 hour, a uniform dispersion was obtained. The resulting dispersion was then coated on a glass plate using a draw bar coating method. Subsequently, the film obtained was dried at 120° C. for 40 minutes while remaining on the glass plate.

The film on the glass was then immersed into water overnight, about 23 hours, and the freestanding film was released from the glass automatically resulting in an intermediate transfer member with a 50 micron thick carbon black/silicone containing polyamideimide layer with a ratio by weight percent of 16 carbon black, and 84 silicone containing polyamideimide.

EXAMPLE II

Preparation of a Single Layer Silicone Containing Polyamideimide/Poylamideimide Blend Intermediate Transfer Member One gram of Color Black FW1 (B.E.T. surface area=320 $m^2/g$, DBP absorption=2.89 ml/g, primary particle diameter=13 nanometers) as obtained from Evonik-Degussa, was mixed with 5.25 grams of a silicone containing polyamideimide, VYLOMAX® HR-14ET (25 weight percent solution in ethanol/toluene=50/50, $T_g$=250° C., and $M_w$=10,000), 28.1 grams of a polyamideimide, VYLOMAX® HR-16NN (14 weight percent solution in N-methylpyrrolidone, $T_g$=320° C., and $M_w$=100,000), both as obtained from Toyobo Company, and 43.8 grams of N-methylpyrrolidone. By ball milling this mixture with 2 millimeter stainless shot with an Attritor for 1 hour, a uniform dispersion was obtained. The resulting dispersion was then coated on a glass plate using a draw bar coating method. Subsequently, the film obtained was dried at 100° C. for 20 minutes, and then 200° C. for an additional 120 minutes while remaining on the glass plate.

The film on the glass was then immersed into water overnight, about 23 hours, and the freestanding film was released from the glass automatically resulting in an intermediate transfer member with a 50 micron thick carbon black/silicone containing polyamideimide/polyamideimide layer with a ratio by weight percent of 16 carbon black, 21 silicone containing polyamideimide and 63 polyamideimide.

EXAMPLE III

Preparation of a Dual Layer Intermediate Transfer Member Comprising a Polyimide Base Layer and a Silicone Containing Polyamideimide Surface Layer A polyimide base or first layer was prepared as follows. One gram of Color Black FW1 (B.E.T. surface area=320 $m^2/g$, DBP absorption=2.89 ml/g, primary particle diameter=13 nanometers) as obtained from Evonik-Degussa, was mixed with 26.25 grams of a polyamic acid (polyimide precursor) solution, VTEC™ PI 1388 (20 weight percent solution in N-methylpyrrolidone, $T_g$>320° C.), as obtained from Richard Blaine International, Incorporated. By ball milling this mixture with 2 millimeter stainless shot with an Attritor for 1 hour, a uniform dispersion was obtained. The resulting dispersion was then coated on a glass plate using a draw bar coating method. Subsequently, the film obtained was dried at 100° C. for 20 minutes, and then 200° C. for an additional 120 minutes while remaining on the glass plate.

A silicone containing polyamideimide surface layer was prepared as follows. One gram of Color Black FW1 (B.E.T. surface area=320 $m^2/g$, DBP absorption=2.89 ml/g, primary particle diameter=13 nanometers) as obtained from Evonik-Degussa, was mixed with 21 grams of the silicone containing polyamideimide, VYLOMAX® HR-14ET (25 weight percent solution in ethanol/toluene=50/50, $T_g$=250° C., and $M_w$=10,000) as obtained from Toyobo Company. By ball milling this mixture with 2 millimeter stainless shot with an Attritor for 1 hour, a uniform dispersion was obtained. The resulting dispersion was then coated on the above polyimide base or first layer present on the glass plate using a draw bar coating method. Subsequently, the resulting dual layer film obtained was dried at 120° C. for 40 minutes while remaining on the glass plate.

The dual layer film on the glass was then immersed into water overnight, about 23 hours, and the freestanding film was released from the glass automatically resulting in a dual layer intermediate transfer member with a 75 micron thick carbon black/polyimide base layer with a ratio by weight percent of 16 carbon black and 84 polyimide, and a 20 micron thick carbon black/silicone containing polyamideimide surface layer with a ratio by weight percent of 16 carbon black and 84 silicone containing polyamideimide.

EXAMPLE IV

Preparation of a Dual Layer Intermediate Transfer Member Comprising a Polyimide Base Layer and a Silicone Containing Polyamideimide/Polyamideimide Blend Surface Layer A polyimide base layer was prepared as follows. One gram of Color Black FW1 (B.E.T. surface area=320 $m^2/g$, DBP absorption=2.89 ml/g, primary particle diameter=13 nanometers) as obtained from Evonik-Degussa, was mixed with 26.25 grams of a polyamic acid (polyimide precursor) solution, VTEC™ PI 1388 (20 weight percent solution in N-methylpyrrolidone, $T_g$>320° C.), as obtained from Richard Blaine International, Incorporated. By ball milling this mixture with 2 millimeter stainless shot with an Attritor for 1 hour, a uniform dispersion was obtained. The resulting dispersion was then coated on a glass plate using a draw bar coating method. Subsequently, the film obtained was dried at 100° C. for 20 minutes while remaining on the glass plate.

A silicone containing polyamideimide/polyamideimide blend surface layer was prepared as follows. One gram of Color Black FW1 (B.E.T. surface area=320 $m^2/g$, DBP absorption=2.89 ml/g, primary particle diameter=13 nanometers) as obtained from Evonik-Degussa, was mixed with 5.25 grams of the silicone containing polyamideimide, VYLOMAX® HR-14ET (25 weight percent solution in ethanol/toluene=50/50, $T_g$=250° C., and $M_w$=10,000), 28.1 grams of a polyamideimide, VYLOMAX® HR-16NN (14 weight percent solution in N-methylpyrrolidone, $T_g$=320° C., and $M_w$=100,000), both obtained from Toyobo Company, and 43.8 grams of N-methylpyrrolidone. By ball milling this mixture with 2 millimeter stainless shot with an Attritor for 1 hour, a uniform dispersion was obtained. The resulting dispersion was then coated on the above prepared polyimide base layer situated on the glass plate using a draw bar coating method. Subsequently, the resulting dual layer film obtained was dried at 100° C. for 20 minutes, and then 200° C. for an additional 120 minutes while remaining on the glass plate.

The above obtained dual layer film on the glass was then immersed into water overnight, about 23 hours, and the freestanding film was released from the glass automatically resulting in a dual layer intermediate transfer member with a 75 micron thick carbon black/polyimide base layer with a ratio by weight percent of 16 carbon black and 84 polyimide, and a 20 micron thick carbon black/silicone containing polyamideimide/polyamideimide top surface layer with a ratio by weight percent of 16 carbon black, 21 silicone containing polyamideimide and 63 polyamideimide.

Surface Resistivity Measurement

The above ITB members or devices of Comparative Example 1, and Examples I and II were measured for surface resistivity (averaging four to six measurements at varying spots, 72° F./65 percent room humidity) using a High Resistivity Meter (Hiresta-Up MCP-HT450 available from Mitsubishi Chemical Corp.). The surface resistivity results are illustrated in Table 1 below.

TABLE 1

| | Surface Resistivity (ohm/sq) | Contact Angle |
|---|---|---|
| Comparative Example 1, Polyamideimide ITB | $4.31 \times 10^9$ | 71° |
| Example I, Silicone Containing Polyamideimide ITB | $6.51 \times 10^9$ | N.A. |
| Example II, Silicone Containing Polyamideimide/Polyamideimide Blend ITB | $5.32 \times 10^9$ | 108° |

When compared with the controlled polyamideimide (Comparative Example 1) ITB device, the disclosed silicone containing polyamideimide (Example I) and silicone containing polyamideimide/polyamideimide blend (Example II), ITB devices possessed similar surface resistivity especially when the carbon black concentration was fixed.

Contact Angle Measurement

The contact angles of water (in deionized water) of the ITB devices of Comparative Example 1 and Example II were measured at ambient temperature (about 23° C.) using the known Contact Angle System OCA (Dataphysics Instruments GmbH, model OCA15. At least ten measurements were performed, and their averages are also reported in Table 1.

The disclosed silicone containing polyamideimide/polyamideimide blend (Example II) ITB device was more hydrophobic (about 40 degrees higher contact angle) than the Comparative Example 1 polyamideimide ITB device. Also, the disclosed Example II silicone containing polyamideimide ITB device is believed to possess improved transfer efficiency, better dimensional, and electrical stability, as compared to that of Comparative Example 1 based on the Table 1 data.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member comprised of a silicone containing polyamideimide represented by

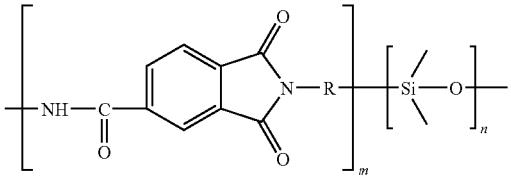

wherein R is alkyl, aryl, or mixtures of alkyl and aryl, and m and n represent the weight percent of each segment.

2. An intermediate transfer member in accordance with claim 1 wherein R is alkyl, or aryl, and which member further includes a supporting substrate in contact with said silicone containing polyamideimide and a conductive component.

3. An intermediate transfer member in accordance with claim 2 wherein alkyl contains from 1 to about 18 carbon atoms, and aryl contains from 6 to about 42 carbon atoms, m is from about 60 to about 99 weight percent, n is from about 1 to about 40 weight percent, and the sum of m+n is about 100 percent and said supporting substrate is a polyimide, a polyetherimide, or a polyamideimide.

4. An intermediate transfer member in accordance with claim 2 wherein R is aryl containing from 6 to about 18 carbon atoms, m is from about 70 to about 90 weight percent, n is from about 10 to about 30 weight percent, and the sum of m+n is about 100 percent.

5. An intermediate transfer member in accordance with claim 2 wherein sad silicone containing polyamideimide is a copolymer that possesses a weight average molecular weight of from about 5,000 to about 150,000, or wherein said silicone containing polyamideimide is a copolymer that possesses a weight average molecular weight of from about 10,000 to about 50,000.

6. An intermediate transfer member in accordance with claim 2 wherein said silicone containing polyamideimide is represented by

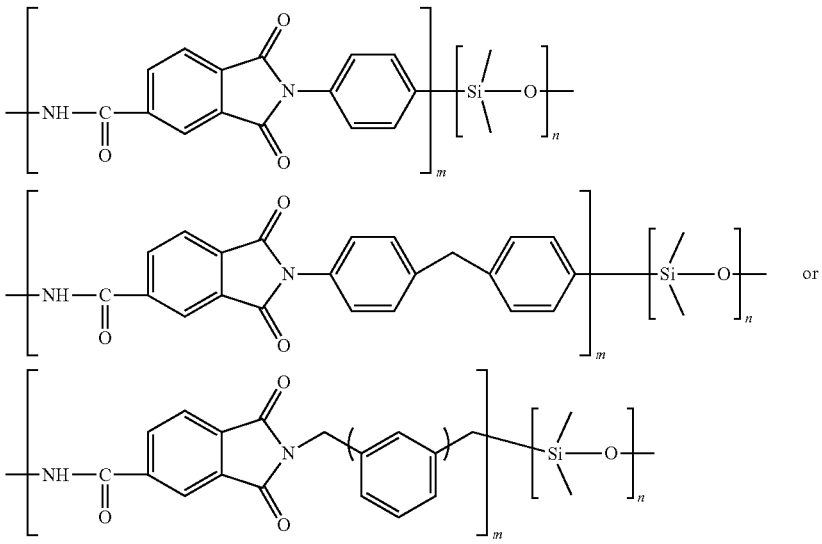

wherein m and n represent the weight percent of each segment, and wherein m is from about 70 to about 95 weight percent, n is from about 5 to about 30 weight percent, and m+n is about 100 percent.

7. An intermediate transfer member in accordance with claim 2 wherein said silicone containing polyamideimide possesses a glass transition temperature of from about 225° C. to about 350° C.

8. An intermediate transfer member in accordance with claim 2 Wherein said silicone containing polyamideimide possesses a glass transition temperature of from about 250° C. to about 300° C.

9. An intermediate transfer member in accordance with claim 2 further including in said silicone containing polyamideimide a second polymer selected from the group consisting of a polyimide, a polycarbonate, a polyamideimide, a polyphenylene sulfide, a polyamide, a polysulfone, a polyetherimide, a polyester, a polyvinylidene fluoride, a polyethylene-co-polytetrafluoroethylene, and mixtures thereof, each present in an amount of from about 10 to about 90 weight percent based on the weight of total solids.

10. An intermediate transfer member in accordance with claim 1 further including a supporting substrate in contact with said silicone containing polyamideimide.

11. An intermediate transfer member in accordance with claim 10 wherein said substrate is comprised of a polyimide.

12. An intermediate transfer member in accordance claim 11 wherein said polyimide is at least one of a polyimide a polyetherimide, a polyamideimide, or mixtures thereof.

13. An intermediate transfer member in accordance with claim 10 wherein said silicone containing polyamideimide is represented by

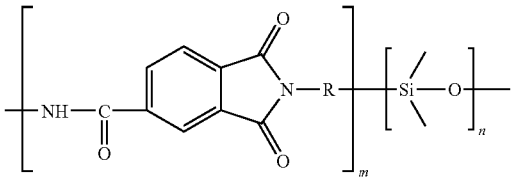

wherein R is alkyl or aryl, and m and n represent the weight percent of each segment and wherein said silicone containing polyamideimide includes a conductive carbon black.

14. An intermediate transfer member in accordance with claim 13 wherein said silicone containing polyamideimide is represented by

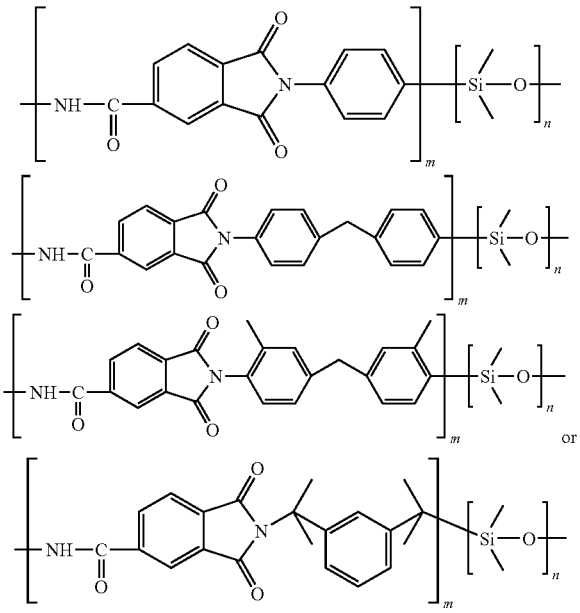

wherein m and n represent the weight percent of each segment, and wherein m is from about 70 to about 95 weight percent, n is from about 5 to about 30 weight percent, and m±n is about 100 percent.

15. An intermediate transfer member in accordance with claim 13 wherein alkyl contains from 1 to about 18 carbon atoms, and aryl contains from 6 to about 42 carbon atoms, m is from about 60 to about 99 weight percent, n is from about 1 to about 40 weight percent, and wherein the sum of m and n is about 100 percent.

16. An intermediate transfer member in accordance with claim 13 wherein R is aryl containing from 6 to about 18 carbon atoms, m is from about 70 to about 90 weight percent, n is from about 10 to about 30 weight percent, and wherein the total of m and n is about 100 percent.

17. An intermediate transfer member in accordance with, claim 13 further including in said silicone containing polyamideimide a second polymer selected from the group consisting of a polyimide, a polycarbonate, a polyamideimide, a polyphenylene sulfide, a polyamide, a polysulfone, a polyetherimide, a polyester, a polvinylidene fluoride, a polyethylene-co-polytetrafluoroethylene, and mixtures thereof.

18. An intermediate transfer member in accordance with claim 13 with a surface resistivity of from about $10^8$ to about $10^{13}$ ohm/sq.

19. An intermediate transfer member in accordance with claim 13 further comprising an outer release layer positioned on said silicone containing polyamideimide.

20. An intermediate transfer member in accordance with claim 19 wherein said release layer comprises a fluorinated ethylene propylene copolymer, a polytetrafluoroethylene, a polyfluoroalkoxy polytetrafluoroethylene, a fluorosilicone, a polymer of vinylidenefluoride, hexafluoropropylene and tetrafluoroethylene, or mixtures thereof.

21. An intermediate transfer member in accordance with claim 13 further including in the silicone containing polyamideimide, a conductive component present in an amount of from about 1 to about 40 percent by weight based on the weight of total solids, and wherein said silicone containing polyamideimide is in the form of a layer in contact with said substrate.

22. An intermediate transfer member in accordance with claim 21 wherein said conductive component is a carbon black, a polyaniline, or a metal oxide, each present in an amount of from about 1 to about 25 percent by weight based on the weight of total solids.

23. An intermediate transfer member consisting of a conductive component, a supporting substrate and thereover a silicone containing polyamideimide as represented by

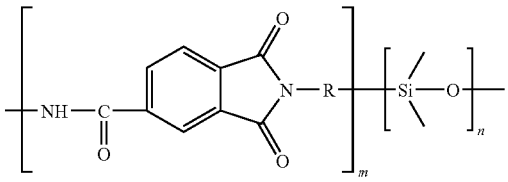

wherein R is alkyl or aryl, and m and n represent the weight percent of each segment.

24. A xerographic intermediate transfer member comprised of said member being connected to a photoconductor and which member is comprised of a polyimide supporting substrate layer, and thereover a silicone containing polyamideimide layer as represented by

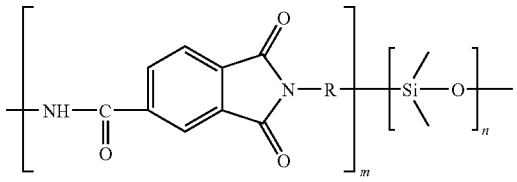

wherein R is alkyl, aryl, or mixtures thereof, and m and n represent the weight percent of each segment.

25. An intermediate transfer member in accordance with claim 24 further comprising an outer release layer positioned on said silicone containing polyamideimide.

26. An intermediate transfer member in accordance with claim 25 wherein said release layer comprises a fluorinated ethylene propylene copolymer, a polytetrafluoroethylene, a polyfluoroalkoxy polytetrafluoroethylene, a fluorosilicone, a polymer of vinylidenefluoride, hexafluoropropylene, and tetrafluoroethylene, or mixtures thereof.

27. An intermediate transfer member in accordance with claim 24 further including an adhesive layer situated between the supporting substrate and the silicone containing polyamideimide layer.

28. An intermediate transfer member in accordance with claim 27 wherein said adhesive layer is of a thickness of from about 1 to about 100 nanometers, and said layer is comprised of an epoxy, a urethane, a silicone, or polyester.

29. An intermediate transfer member in accordance with claim 24 wherein said substrate is of a thickness of from about 20 to about 300 microns, said silicone containing polyamideimide layer is of a thickness of from about 1 to about 150 microns, and said silicone containing polyamideimide layer possesses a weight average molecular weight of from about 10,000 to about 50,000, and wherein the weight percent thereof of said silicone in said silicone containing polyamideimide layer is from about 5 to about 40, and wherein the total of said components in said silicone containing polyamideimide layer is about 100 percent.

30. An intermediate transfer member in accordance with claim 24 further including in said silicone containing polyamideimide layer a carbon black, a metal oxide, a polyaniline, or mixtures thereof.

31. An intermediate transfer member in accordance with claim 23 wherein R is alkyl containing from 1 to about 12 carbon atoms.

32. An intermediate transfer member in accordance with claim 23 wherein R is aryl containing from 6 to about 18 carbon atoms.

33. An intermediate transfer member in accordance with claim 24 wherein R is alkyl containing from 1 to about 12 carbon atoms.

34. An intermediate transfer member in accordance with claim 24 wherein R is aryl containing from 6 to about 18 carbon atoms.

* * * * *

UNITED STATES PATENT AND TRADEMARK OFFICE

CERTIFICATE OF CORRECTION

PATENT NO. : 8,377,523 B2
APPLICATION NO. : 12/493535
DATED : February 19, 2013
INVENTOR(S) : Jin Wu It is certified that error appears in the above-identified patent and that said Letters Patent is hereby corrected as shown below:

On the first page title sheet of the above identified patent include:

Assignee: Xerox Corporation of Norwalk CT

Signed and Sealed this
Eighth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,377,523 B2
APPLICATION NO. : 12/493535
DATED : February 19, 2013
INVENTOR(S) : Jin Wu It is certified that error appears in the above-identified patent and that said Letters Patent is hereby corrected as shown below:

On the Title page, "item (76)" should read -- item (75) --.

On the Title page of the above identified patent include:

Assignee: Xerox Corporation of Norwalk CT.

This certificate supersedes the Certificate of Correction issued April 8, 2014.

Signed and Sealed this
Sixth Day of May, 2014

Michelle K. Lee

Michelle K. Lee
*Deputy Director of the United States Patent and Trademark Office*